US006170520B1

(12) United States Patent
Narita et al.

(10) Patent No.: US 6,170,520 B1
(45) **Date of Patent: *Jan. 9, 2001**

(54) PRESSURE CONTROL VALVE FOR SOLENOID VALVE AGGREGATE AND SOLENOID VALVE ASSEMBLY PROVIDED WITH THE SAME

(75) Inventors: Masaru Narita; Bunya Hayashi; Makoto Ishikawa, all of Tsukuba-gun (JP)

(73) Assignee: SMC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/335,523

(22) Filed: Jun. 18, 1999

(30) Foreign Application Priority Data

Jul. 14, 1998 (JP) ..... 10-199046

(51) Int. Cl.[7] ..... F15B 13/08
(52) U.S. Cl. ..... 137/596.16; 137/884
(58) Field of Search ..... 137/596.16, 884

(56) References Cited

U.S. PATENT DOCUMENTS

| | | | |
|---|---|---|---|
| 2,651,324 | 9/1953 | Hodgson et al. . | |
| 3,225,781 | 12/1965 | Kruger et al. . | |
| 3,513,876 | 5/1970 | Tarbox | 137/884 X |
| 5,829,481 | 11/1998 | Tajima et al. | 137/884 |
| 5,988,214 | 11/1999 | Tajima e tal. | 137/884 X |
| 6,012,490 | 1/2000 | Tajima et al. | 137/884 |

FOREIGN PATENT DOCUMENTS

| | | |
|---|---|---|
| 1 259 662 | 1/1968 | (DE) . |
| 2 022 462 | 1/1971 | (DE) . |
| 1 798 425 | 3/1973 | (DE) . |
| 2 015 430 | 4/1970 | (FR) . |

OTHER PUBLICATIONS

Götz ET AL., "Hydraulik in Theorie und Praxis, "1995, Robert Bosch GmbH, Stuttgart, Germany, pp. 261 and 266. (No English translation).

Search Report For European Application No. EP 99305555.

*Primary Examiner*—Gerald A. Michalsky
(74) *Attorney, Agent, or Firm*—Oblon, Spivak, McClelland, Maier & Neustadt, P.C.

(57) ABSTRACT

A pressure control valve adapted to supply a secondary pressure required in fluid pressure equipment from a plurality of solenoid valves by a simple means is provided. For this purpose, a pressure control valve 1 for supplying a pressure fluid, the pressure of which has been regulated, to a supply passage 61 in an solenoid valve aggregate 6 formed of a plurality of solenoid valves 60 arranged side by side in a line is employed by placing it between a supply-exhaust block 5 for supplying and discharging a pressure fluid from and to the outside and the solenoid valve aggregate 6. A control valve body 10 of the pressure control valve 1 is provided with: an input port in communication with a supply port 51 of the supply-exhaust block 5; an output port in communication with a supply passage 61 installed through the solenoid valve aggregate 6; a pressure regulating mechanism which regulates the pressure of the pressure fluid supplied from the supply port 51 and outputs a secondary pressure to the supply passage 61 of the solenoid valve aggregate 6 through the output port; and an exhaust passage that directly links a discharge passage of the solenoid valve aggregate 6 and an exhaust port 52 of the supply-exhaust block.

5 Claims, 2 Drawing Sheets

PRESSURE CONTROL VALVE FOR SOLENOID VALVE AGGREGATE AND SOLENOID VALVE ASSEMBLY PROVIDED WITH THE SAME

FIELD OF THE INVENTION

The present invention relates to a pressure control valve for use with a solenoid valve aggregate having a plurality of solenoid valves arranged side by side in a line, and a solenoid valve assembly equipped with the same.

PRIOR ART

In fluid pressure equipment, there are cases wherein a fluid pressure supplied to the fluid pressure equipment is required to be adjusted according to a set pressure or an operating condition of the equipment. To adjust the supplied fluid pressure, it is necessary to install a pressure control valve such as a pressure reducing valve in a pipe through which a pressure fluid is supplied or discharged to or from the fluid pressure equipment.

However, it would require a large installation space and increase cost to install pressure control valves as necessary in the pipes of many solenoid valves in a solenoid valve aggregate in order to supply a pressure fluid to respective parts of the fluid pressure equipment by the solenoid valve aggregate having a plurality of solenoid valves arranged side by side in a line. Further, if a fluid of the same pressure is supplied to a plurality of parts of the fluid pressure equipment via a plurality of pressure control valves, then overlapping equipment would occupy an installation space, resulting in a disadvantage costwise.

DISCLOSURE OF THE INVENTION

A basic technological object of the present invention is to provide a pressure control valve that can be placed between a solenoid valve aggregate, which has a plurality of solenoid valves arranged side by side in a line, and a supply-exhaust block for supplying and discharging a pressure fluid to them, or to provide a solenoid valve assembly that incorporates the pressure control valve.

A specific technological object of the present invention is to provide a pressure control valve that permits a supply-exhaust block and a solenoid valve aggregate, which have conventionally been employed, to be used as they are and that can be used by being placed therebetween so as to make it possible to supply a pressure fluid, the pressure of which has been reduced, from the respective solenoid valves constituting the solenoid valve aggregate.

Another technological object of the present invention is to provide a pressure control valve that allows a different secondary pressure required in fluid pressure equipment to be supplied for each set of a plurality of sets of solenoid valve aggregates by a simple means, or to provide a solenoid valve assembly that incorporates the pressure control valve.

To fulfill the objects, according to the present invention, there is provided a pressure control valve for a solenoid valve aggregate, the pressure control valve being a pressure control valve for supplying a pressure fluid, the pressure of which has been adjusted, to a supply passage in a solenoid valve aggregate that has the supply passage and a discharge passage installed through a plurality of solenoid valves arranged side by side in a line. The body of the control valve placed between a supply-exhaust block, which has a supply port through which a pressure fluid is supplied from the outside and an exhaust port to the outside, and the solenoid valve aggregate is provided with an input port in communication with the supply port of the supply-exhaust block, an output port in communication with the supply passage installed through the solenoid valve aggregate, a pressure regulating mechanism that regulates the pressure of the pressure fluid supplied through the supply port of the supply-exhaust block and outputs a secondary pressure to the supply passage of the solenoid valve aggregate through the output port, and an exhaust passage that provides direct communication between the discharge passage of the solenoid valve aggregate and the exhaust port of the supply-exhaust block.

Further, a solenoid valve assembly in accordance with the present invention is provided with a solenoid valve aggregate that has a plurality of solenoid valves arranged side by side in a line and a supply passage and a discharge passage installed therethrough, the pressure control valve that supplies a pressure fluid, the pressure of which has been regulated, through the supply passage, a supply-exhaust block that has a supply port through which a pressure fluid is supplied from the outside and an exhaust port to the outside, and a coupling means for coupling the solenoid valve aggregate, the pressure control valve, and the supply-exhaust block arranged side by side in a line.

In the solenoid valve assembly, a plurality of sets of the solenoid valve aggregates, the pressure control valves, and the supply-exhaust blocks are coupled by a single coupling means. A plurality of sets of solenoid valve aggregates having different fluid pressures to be output can be incorporated in a single solenoid valve assembly.

Further, a pressure regulating mechanism in the pressure control valve may be constructed such that a valve hole is provided in the body of the control valve in parallel to the surface of junction to the solenoid valve aggregate, a pressure regulating valve rod is slidably inserted in the valve hole, the pressure regulating valve rod is equipped with a valve member that moves into contact with or away from a valve seat provided at the valve hole so as to open or close the passage between the input port and the output port, and both ends of the pressure regulating valve rod are provided with valve rod urging means for setting the opening of the valve seat by the valve member according to the force of action based on a fluid pressure at the output port and an urging force of a pressure regulating spring that sets a secondary pressure and for regulating the secondary pressure to a set value by the pressure regulating spring.

The pressure control value for the solenoid valve aggregate having the configuration set forth above is placed between a supply-exhaust block that has a supply port for a pressure fluid from the outside and an exhaust port to the outside and the solenoid valve aggregate having a plurality of juxtaposed solenoid valves, and used as a solenoid valve assembly. In this solenoid valve assembly, the pressure fluid supplied through the supply port of the supply-exhaust block is introduced into the pressure regulating mechanism from the input port in the control valve body, reduced in pressure to a predetermined secondary pressure set by the pressure regulating spring, sent to the respective solenoid valves through the supply passage of the solenoid valve aggregate from the output port, and sent from the solenoid valves to respective actuators in fluid pressure equipment. The exhaust from the fluid pressure equipment is performed from the exhaust passage of the solenoid valve aggregate through the exhaust path of the control valve body and the exhaust port of the supply-exhaust block.

Thus, since the pressure control valve is used by being provided between the supply-exhaust block and the solenoid valve aggregate having a plurality of juxtaposed solenoid valves, a supply-exhaust block and a solenoid valve aggregate that have been hitherto employed can be used as they are to constitute the solenoid valve aggregate that supplies a pressure air, which has been reduced in pressure. Moreover, a plurality of sets of the supply-exhaust blocks, the pressure control valves, and the solenoid valve aggregates can be coupled by a single coupling means to set different secondary pressure at the pressure control valve for each set of the solenoid valve aggregate, thereby providing various fluid pressures required in the fluid pressure equipment. This achieves a markedly simpler configuration compared with a case wherein the pressure control valve is provided in the passage of each solenoid valve.

DETAILED DESCRIPTION OF THE PREFERRED EMBODIMENT

Figure 1:
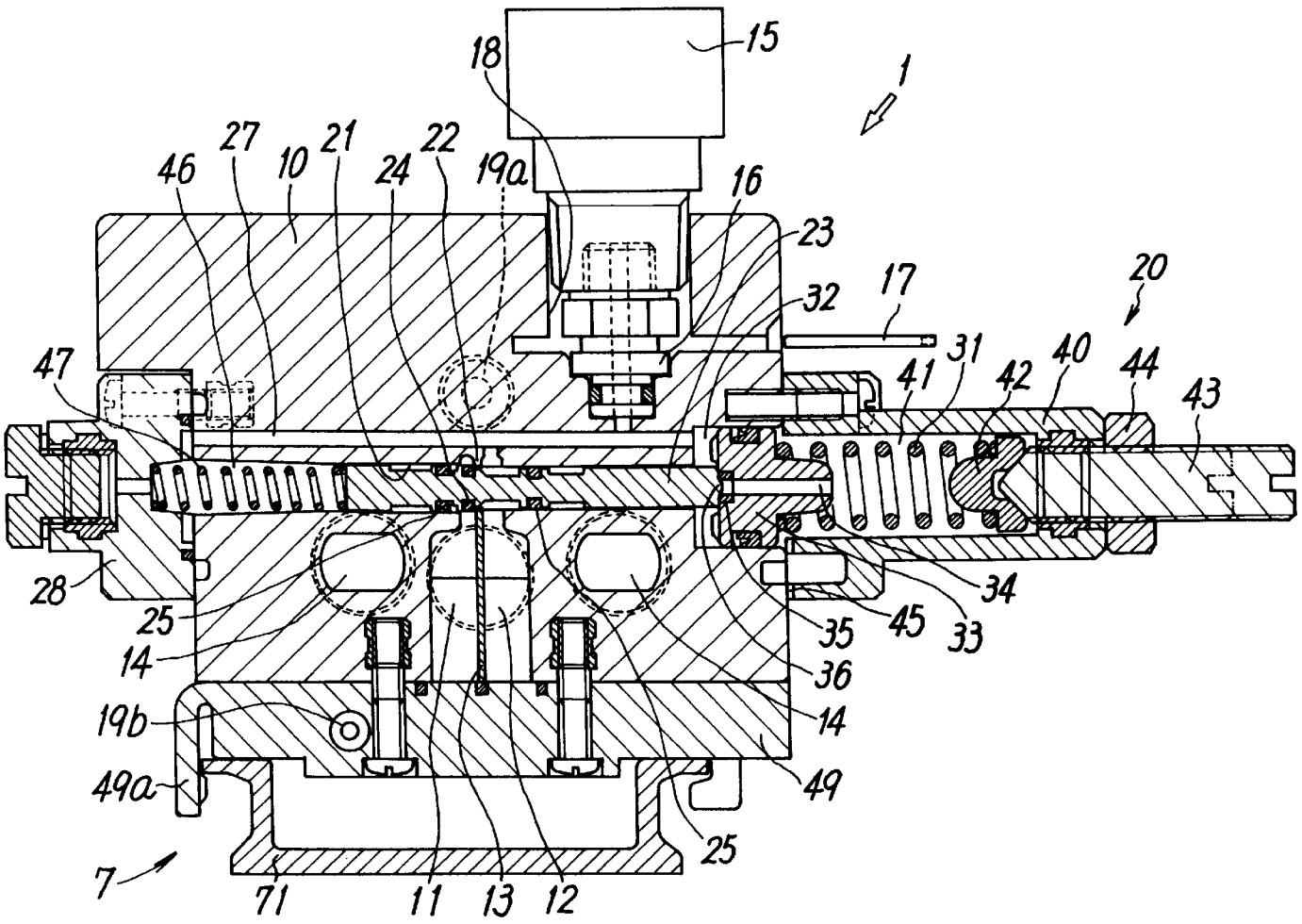
FIG. 1 is a sectional view showing a first embodiment of a pressure control valve for a solenoid valve aggregate in accordance with the present invention.
Figure 2:
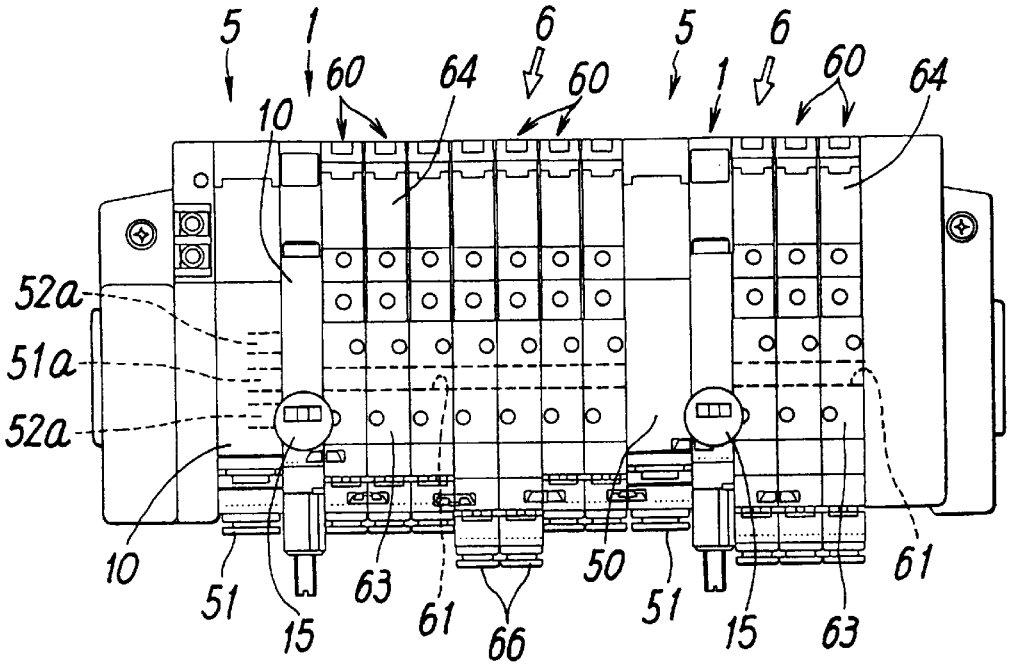
FIG. 2 is a top plan view showing an example of the configuration of a solenoid valve assembly equipped with the pressure control valve.
Figure 3:
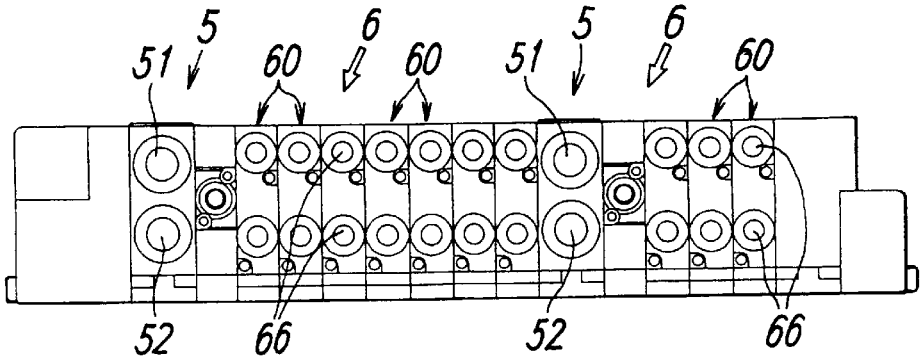
FIG. 3 is a front view of the foregoing solenoid valve assembly.

The accompanying drawings illustrate an embodiment of the present invention, wherein FIG. 1 shows the configuration of a pressure control valve for a solenoid valve aggregate in accordance with the present invention, and FIG. 2 and FIG. 3 illustrate an example of the configuration of a solenoid valve assembly equipped with the same.

A pressure control valve 1 shown in FIG. 1 is provided between a supply-exhaust block 5, which has a supply port 51 and an exhaust port 52 for a pressure fluid, and a solenoid valve aggregate 6 constituted by a plurality of solenoid valves 60 arranged side by side in a line as can be seen from FIG. 2 and FIG. 3, and it supplies the pressure fluid, which has been regulated to a required secondary pressure, to the respective solenoid valves 60 in the solenoid valve aggregate 6. These supply-exhaust block 5, the pressure control valve 1, and the solenoid valve aggregate 6 are installed consecutively into one piece by a coupling means 7 (FIG. 1) which will be discussed later.

As shown in FIG. 1, a control valve body 10 of the pressure control valve 1 is equipped with an input port 11 in communication with the supply port 51 of the supply-exhaust block 5, an output port 12 which is formed at the input port 11 via a partition 13 and in communication with a supply passage 61 (FIG. 2) installed through the solenoid valve aggregate 6, and two exhaust passages 14 positioned on both sides thereof.

Meanwhile, the supply-exhaust block 5 has an inlet passage 51*a* for a pressure fluid supplied from the outside through the supply port 51, the inlet passage 51*a* being opened at the position corresponding to the input port 11 and the output port 12 of the control valve body 10, and an exhaust outlet passage 52*a* for discharge through the exhaust port 52, the outlet passage 52*a* being opened at a position corresponding to a pair of the exhaust passages 14 in the control valve body 10.

Although it is not shown, in order to link the input port 11 in the control valve body 10 only to the inlet passage 51*a* of the supply-exhaust block 5, the end of the output port 12 of the control valve body 10 that faces the supply-exhaust block 5 is closed at the end wall, while the end of the input port 11 of the control valve body 10 that faces the solenoid valve aggregate 6 is closed at the end wall in order to link the output port 12 in the control valve body 10 only to the supply passage 61 of the solenoid valve aggregate 6.

The supply-exhaust block 5 may have the input ports 11 and the output ports 12 opened in the pressure control valves 1 and the solenoid valve aggregates 6 located on both sides thereof as necessary; in this embodiment, however, the case where the input port 11 and the output port 12 are opened only in the pressure control valve 1 joined to one side thereof is shown.

Meanwhile, the respective solenoid valves 60 making up the solenoid valve aggregate 6 are formed of main valves 63 and pilot valves 64, the supply passage 61 installed through the main valves 63 and discharging passages located in parallel to both sides thereof being provided (not shown). The main valve 63 is equipped with a supply port for a pressure fluid in communication with the supply passage 61, first and second output ports, and first and second discharge ports in communication with the discharge passage, and it has a well-known switching valve mechanism wherein the passage between the ports is switched by a valve body driven by the pilot valve 64. Hence, the pressure fluid which has the pressure thereof regulated in the pressure control valve 1 and has been introduced through the supply passage 61 is supplied by the operation of the pilot valve 64 to a required actuator in the fluid pressure equipment through one of paired output ports 66 and 66 provided at one end of each solenoid valve 60, and discharged through the discharge passage by the switching operation of the valve body of the pilot valve. The solenoid valve may be formed of a three-port valve.

With this arrangement, the inlet passage 51*a* and the supply passage 61 are linked, and the outlet passage 52*a* and the discharge passage of the solenoid valve aggregate 6 are also linked, so that when the supply-exhaust block 5 and the solenoid valve aggregate 6 are directly connected without placing the pressure control valve 1 therebetween, a well-known solenoid valve assembly is configured in which the fluid pressure introduced from the supply port 51 is directly supplied to the fluid pressure equipment through the solenoid valve 60. This means that the solenoid valve assembly in accordance with the present invention can be constructed by placing the pressure control valve 1 between the supply-exhaust block 5 and the solenoid valve aggregate 6 in the solenoid valve assembly that has conventionally been used.

The control valve body 10 of the pressure control valve 1 has been approximated in appearance to the solenoid valve 60 as much as possible; it is equipped with a pressure regulating mechanism 20 that regulates the pressure of the pressure fluid supplied through the input port 11 from the supply port 51 and the inlet passage 51*a* of the supply-exhaust block 5, and outputs a secondary pressure through the output port 12 to the supply passage 61 of the solenoid valve aggregate 6.

The pressure regulating mechanism 20 has a valve hole 21 provided in the control valve body 10 in parallel to the surface of junction to the solenoid valve aggregate 6 and also in parallel to the axis of the valve body of the solenoid valve 60. A pressure regulating valve rod 23 is slidably inserted in the valve hole 21; the pressure regulating valve rod 23 is equipped with a valve member 24 that moves, from the input port 11 side, into contact with or away from a valve seat 22 provided between the input port 11 and the output port 12 at the valve hole 21 so as to open or close the passage between the input port 11 and the output port 12; and the pressure regulating valve rod 23 is provided with a valve rod urging means for regulating the fluid pressure at the output port 12, that is, the secondary pressure, to the value set by a pressure regulating spring 31. In FIG. 1, reference numeral 25 denotes sealing members in the valve hole 21 that are located on both sides of the valve member 24.

The urging means of the valve rod opens or closes the valve seat 22 by means of the valve member 24 according mainly to the force of action based on the fluid pressure (secondary pressure) at the output port 12 and the urging force of the pressure regulating spring 31 that sets the secondary pressure. A pressure regulating passage 27 in communication with the output port 12 is provided in parallel to the valve hole 21, and the pressure regulating passage 27 and one end of the valve hole 21 are interconnected in an end cover 28 installed at one end of the control valve body 10, while the other end of the pressure regulating passage 27 is opened to a pressure regulating piston chamber 32 formed at the end of the valve hole 21 in the control valve body 10. The pressure regulating piston chamber 32 is formed by inserting a pressure regulating piston 33 in the hole formed in the end of the control valve body 10. A relief hole 34 is provided at the center of the pressure regulating piston 33, a pressure regulating sealing member 35 is provided at the end thereof facing the pressure regulating piston chamber 32, and a valve section 36 is formed at the end of the pressure regulating valve rod 23 and disposed such that it faces against and moves into contact with or away from the pressure regulating sealing member 35.

The outer side of the pressure regulating piston 33 is covered by a pressure regulating case 40 coupled to the control valve body 10. In a spring chamber 41 formed by and in the pressure regulating case 40, the pressure regulating spring 31 is placed between the pressure regulating piston 33 and a spring seat 42, and the spring seat 42 is inserted such that it can be moved in the axial direction thereof for making adjustment by a pressure regulating screw 43 threaded onto the distal end of the pressure regulating case 40. The relief hole 34 provided in the pressure regulating piston 33 links the pressure regulating piston chamber 32 to the spring chamber 41 in the pressure regulating case 40 when the valve section 36 is released, the spring chamber 41 being in communication with the outside through a breather hole 45. In the drawing, reference numeral 44 denotes a locknut.

Further, the pressure regulating valve rod 23 is urged in the direction for pressing the valve member 24 into contact with the valve seat 22 by a spring 47 provided in a compressed state in a pressure chamber 46 formed on the side facing the end cover 28 of the valve hole 21.

Meanwhile, a pressure display unit 15 is installed on the control valve body 10. The pressure display unit 15 is installed by opening a display unit mounting hole 18, which is linked to the pressure regulating passage 27, in the control valve body 10, a pressure inlet sleeve 16 with an engaging groove of the pressure display unit 15 is airtightly inserted in the mounting hole 18, and the leg of a U-shaped pin 17 that is inserted in the control valve body 10 is locked in the engaging groove thereby to install the pressure display unit 15. In the drawing, reference numeral 19*a* denotes a pilot air supply passage, and reference numeral 19*b* denotes an exhaust passage.

In the solenoid valve assembly illustrated in FIG. 2 and FIG. 3, a plurality of sets of the solenoid valve aggregates 6 formed of a plurality of juxtaposed solenoid valves 60, pressure control valves 1 for outputting a pressure fluid with the pressure thereof regulated, and supply-exhaust blocks 5 having supply ports 51 for supplying a pressure fluid from the outside and exhaust ports 52 to the outside are installed side by side and coupled by the single coupling means 7. Regarding the coupling means 7, a case is shown wherein the solenoid valve aggregates 6, the pressure control valves 1, and the supply-exhaust blocks 5 are installed side by side on a rail 71 shown in FIG. 1, and clamped between end blocks 72 provided on both ends and secured to the rail 71. In this case, the respective solenoid valves 60 in the solenoid valve aggregates 6 and the supply-exhaust blocks 5 are locked to the rail 71 by using retaining metal fixtures, and the pressure control valves 1 are locked by a retaining section 49*a* which is provided on a bottom cover 49 closing the bottom end of the passage linking the input port 11 and the output port 12 to the valve hole 21 and which elastically locks. The coupling means 7 is not limited to the one set forth above; other various coupling means may be adopted.

As illustrated, a plurality of sets of the supply-exhaust blocks 5, the pressure control valves 1, and the solenoid valve aggregates 6 are connected, and a different secondary pressure is set at the pressure control valve 1 for each set of the solenoid valve aggregate 6, thus making it possible to provide various fluid pressures required in fluid pressure equipment. This achieves a markedly simpler configuration compared with a case wherein the pressure control valve is provided in the passage of each solenoid valve 60. It is of course possible, however, to use one set of the supply-exhaust block 5, the pressure control valve 1, and the solenoid valve aggregate 6 that are connected.

The pressure control valve 1 having the configuration set forth above is placed between the supply-exhaust block 5 and the solenoid valve aggregate 6 having the solenoid valves 60 arranged side by side in a line to use as a solenoid valve assembly. The secondary pressure provided by the urging force of the pressure regulating spring 31 is preset by driving the pressure regulating screw 43 in or out. In the solenoid valve assembly, when a pressure fluid (compressed air) is supplied from the supply port 51 of the supply-exhaust block 5 through the input port 11, it is introduced into the pressure regulating mechanism 20 from the input port 11 in the control valve body 10, reduced to a predetermined secondary pressure set by the pressure regulating spring 31, sent from the output port 12 to the respective solenoid valves 60 through the supply passage 61 of the solenoid valve aggregate 6, and sent from the solenoid valves 60 to the respective actuators in fluid pressure equipment. The exhaust from the fluid pressure equipment is performed from the exhaust passage of the solenoid valve aggregate 6 through the exhaust passages 14 of the control valve body 10 and the exhaust port 52 of the supply-exhaust block 5.

The operation of the pressure regulating mechanism 20 will be further specifically described. First, a pressure fluid supplied from the supply port 51 of the supply-exhaust block 5 through the input port 11 in the control valve body 10 flows toward the output port 12 according to the opening of the valve member 24 opposed to the valve seat 22. The fluid pressure at the output port 12 passes through the pressure regulating passage 27 into the pressure regulating piston chamber 32 at one end of the valve hole 21 and resists the urging force of the pressure regulating spring 31 acting on the pressure regulating piston 33. Meanwhile, the fluid pressure passed through the pressure regulating passage 27 into the pressure chamber 46 on the other end of the valve hole 21 and the urging force of the spring 47 acting on the end of the pressure regulating valve rod 23 urges the valve member 24 in the direction for pressing it into contact with the valve seat 22 of the valve hole 21. The opening of the valve member 24 is set based on the balance of the aforesaid urging forces, thereby to regulate the pressure fluid passing into the output port 12 to the secondary pressure that is set by the urging force of the pressure regulating spring 31.

When the secondary pressure rises higher than the pressure set by the pressure regulating spring 31, the action of the fluid pressure moving into the pressure chamber 46 through the pressure regulating passage 27 causes the valve member 24 to close the valve seat 22 and the fluid pressure in the pressure regulating piston chamber 32 to act on the pressure regulating piston 33 to compress the pressure regulating spring 31. Thus, the fluid pressure in the pressure regulating piston chamber 32 is discharged to the outside through the relief hole 34 of the pressure regulating piston 33, the spring chamber 41, and the breather hole 45, so that the secondary pressure is regulated to a predetermined pressure. The fluid pressure is detected and displayed by the pressure display unit 15 mounted on the control valve body 10.

Thus, by providing the pressure control valve 1 between the supply-exhaust block 5 and the solenoid valve aggregate 6 composed of a plurality of juxtaposed solenoid valves 60 and by properly setting the passages of the pressure fluid, the supply-exhaust block 5 and the solenoid valve aggregate 6 that have been conventionally used can be used as they are to constitute the solenoid valve aggregate 6 that supplies pressure air, the pressure of which has been reduced.

According to the pressure control valve for a solenoid valve aggregate and a solenoid valve assembly equipped with the same in accordance with the present invention set forth above in detail, the supply-exhaust block and the solenoid valve aggregate that have conventionally been used can be employed as they are, and a pressure control valve that can be used by being placed therebetween can be provided, permitting the supply of a pressure fluid, the pressure of which has been reduced, from a plurality of solenoid valves making up the solenoid valve aggregate.

Moreover, according to the present invention, it is possible to provide a pressure control valve that allows a different secondary pressure required in fluid pressure equipment to be supplied for each set of a plurality of sets of solenoid valve aggregates by a simple means, or to provide a solenoid valve assembly that incorporates the pressure control valve.

What is claimed is:

1. A pressure control valve for a solenoid valve aggregate, the pressure control valve being for supplying a pressure fluid, the pressure of which has been regulated, to a supply passage in the solenoid valve aggregate having a plurality of solenoid valves arranged side by side in a line through which the supply passage and a discharge passage are installed, wherein:

a control valve body placed between a supply-exhaust block, which has a supply port through which the pressure fluid is supplied from the outside and an exhaust port to the outside, and the solenoid valve aggregate is provided with an input port in communication with the supply port of the supply-exhaust block, an output port in communication with the supply passage installed through the solenoid valve aggregate, a pressure regulating mechanism that regulates the pressure of the pressure fluid supplied through the supply port of the supply-exhaust block and outputs a secondary pressure to the supply passage of the solenoid valve aggregate through the output port, and an exhaust passage that provides direct communication between the discharge passage of the solenoid valve aggregate and the exhaust port of the supply-exhaust block.

2. A pressure control valve according to claim 1, wherein the pressure regulating mechanism provided on the control valve body is configured such that a valve hole is provided in the control valve body in parallel to a surface of junction to the solenoid valve aggregate, a pressure regulating valve rod is slidably inserted in the valve hole, the pressure regulating valve rod is equipped with a valve member that moves into contact with or away from a valve seat provided at the valve hole so as to open or close a passage between the input port and the output port, and both ends of the pressure regulating valve rod are provided with valve rod urging means for setting the opening of the valve seat by the valve member according to the force of action based on a fluid pressure at the output port and an urging force of a pressure regulating spring that sets a secondary pressure and for regulating the secondary pressure to a set value by the pressure regulating spring.

3. A solenoid valve assembly comprising: a solenoid valve aggregate that has a plurality of solenoid valves arranged side by side in a line and a supply passage and a discharge passage installed therethrough, a pressure control valve that supplies a pressure fluid, the pressure of which has been regulated, through the supply passage, a supply-exhaust block that has a supply port through which a pressure fluid is supplied from the outside and an exhaust port to the outside, and coupling means for coupling the solenoid valve aggregate, the pressure control valve, and the supply-exhaust block arranged side by side in a line;

wherein a control valve body of the pressure control valve placed between the solenoid valve aggregate and the supply-exhaust block comprises an input port in communication with a supply port of the supply-exhaust block, an output port in communication with the supply passage installed through the solenoid valve aggregate, a pressure regulating mechanism which regulates the pressure of a pressure fluid supplied from the supply port of the supply-exhaust block and outputs a secondary pressure to the supply passage of the solenoid valve aggregate through the output port, and an exhaust passage that provides direct communication between the discharge passage of the solenoid valve aggregate and the exhaust port of the supply-exhaust block.

4. A solenoid valve assembly according to claim 3, wherein the pressure regulating mechanism provided on the control valve body is configured such that a valve hole is provided in the control valve body in parallel to a surface of junction to the solenoid valve aggregate, a pressure regulating valve rod is slidably inserted in the valve hole, the pressure regulating valve rod is equipped with a valve member that moves into contact with or away from a valve seat provided at the valve hole so as to open or close a passage between the input port and the output port, and both ends of the pressure regulating valve rod are provided with valve rod urging means for setting the opening of the valve seat by the valve member according to the force of action based on a fluid pressure at the output port and an urging force of a pressure regulating spring that sets a secondary pressure and for regulating the secondary pressure to a set value by the pressure regulating spring.

5. A solenoid valve assembly according to claim 3 or claim 4, wherein a plurality of sets of the solenoid valve aggregates, the pressure control valves, and the supply-exhaust blocks are coupled by a single coupling means.

* * * * *